US006869372B1

(12) United States Patent
Higginbotham et al.

(10) Patent No.: US 6,869,372 B1
(45) Date of Patent: Mar. 22, 2005

(54) COMPOSITE WRAP BAT

(75) Inventors: Brian E. Higginbotham, Tullahoma, TN (US); Terry Sutherland, Ottawa (CA)

(73) Assignee: Worth, LLC, Tullahoma, TN (US)

( * ) Notice: Subject to any disclaimer, the term of this patent is extended or adjusted under 35 U.S.C. 154(b) by 0 days.

(21) Appl. No.: 10/232,845

(22) Filed: Aug. 30, 2002

Related U.S. Application Data

(63) Continuation of application No. 09/571,018, filed on May 15, 2000, now Pat. No. 6,464,260.

(51) Int. Cl.[7] ..... A63B 59/06
(52) U.S. Cl. ..... 473/566; 473/567
(58) Field of Search ..... 473/564–568, 473/457, 519, 520

(56) References Cited

U.S. PATENT DOCUMENTS

| | | | | |
|---|---|---|---|---|
| 1,121,189 | A | | 12/1914 | Lincoln |
| 2,944,820 | A | | 7/1960 | Paullus |
| 3,129,003 | A | | 4/1964 | Mueller et al. |
| 3,184,236 | A | | 5/1965 | Zens |
| 3,433,481 | A | | 3/1969 | Tanguay |
| 3,598,410 | A | | 8/1971 | Costopoulos |
| 3,972,528 | A | | 8/1976 | McCracken et al. |
| 3,997,161 | A | | 12/1976 | Lemke, Jr. |
| 4,014,542 | A | | 3/1977 | Tanikawa |
| 4,023,801 | A | | 5/1977 | Van Auken |
| 4,025,377 | A | | 5/1977 | Tanikawa |
| 4,032,143 | A | | 6/1977 | Mueller et al. |
| 4,082,277 | A | | 4/1978 | Van Auken |
| 4,084,819 | A | | 4/1978 | Van Auken |
| 4,086,115 | A | | 4/1978 | Sweet, Jr. et al. |
| 4,092,025 | A | | 5/1978 | Yanagioka |
| 4,113,248 | A | * | 9/1978 | Yanagioka ..... 473/566 |
| 4,131,701 | A | | 12/1978 | Van Auken |

(List continued on next page.)

FOREIGN PATENT DOCUMENTS

JP 406091026 * 4/1994

OTHER PUBLICATIONS

Worth America's Baseball/Softball Company 1990/1991 Catalog.

*Primary Examiner*—Mark S. Graham
(74) *Attorney, Agent, or Firm*—Waddey & Patterson, P.C.; Edward D. Lanquist, Jr.; Phillip E. Walker

(57) ABSTRACT

A metal baseball or softball bat may be improved both for durability and performance by selectively placing a layer of fiber reinforced composite material around portions of the bat. In one embodiment, the barrel portion of the bat may have a fiber reinforced composite layer directly laid up upon the metal bat frame. In a second embodiment, the barrel portion of the bat may include an outer metal sleeve placed about the metal bat frame, with an exterior fiber reinforced composite shell being formed on the outer metal sleeve. In a third embodiment, an intermediate portion of the bat adjacent a zone of maximum bending stress may be reinforced by the placement of a fiber reinforced composite outer layer on the metal frame of the bat adjacent the area of maximum bending stress.

3 Claims, 5 Drawing Sheets

U.S. PATENT DOCUMENTS 4,135,035 A 1/1979 Branen et al.
4,173,670 A 11/1979 Van Auken
4,241,115 A 12/1980 Temin
4,324,400 A 4/1982 Tse
4,351,786 A 9/1982 Mueller
4,361,325 A 11/1982 Jansen
4,373,718 A 2/1983 Schmidt
4,399,992 A 8/1983 Molitor
4,413,822 A 11/1983 Fernandez et al.
4,436,305 A 3/1984 Fernandez
4,498,672 A 2/1985 Bulla
4,505,479 A * 3/1985 Souders ..... 473/566
4,537,398 A 8/1985 Salminen
4,541,629 A 9/1985 Witkowski
4,546,976 A 10/1985 Jones
4,569,521 A * 2/1986 Mueller ..... 473/566
4,572,508 A 2/1986 You
4,579,343 A 4/1986 Mortvedt
4,614,341 A 9/1986 Fernandez
4,684,131 A 8/1987 Mortvedt
4,705,273 A 11/1987 Ament et al.
4,720,104 A 1/1988 DiSieno
4,732,383 A 3/1988 Ferrari et al.
4,746,117 A 5/1988 Noble et al.
4,763,900 A 8/1988 Carr
4,834,370 A 5/1989 Noble et al.
4,848,745 A 7/1989 Bohannan et al.
4,923,541 A 5/1990 Burger
4,928,965 A 5/1990 Yamaguchi et al.
4,981,737 A 1/1991 Rico
5,077,106 A 12/1991 Dursch et al.
5,083,780 A * 1/1992 Walton et al. ..... 473/320
5,088,735 A 2/1992 Shigetoh
5,093,162 A 3/1992 Walton et al.
5,104,123 A 4/1992 Okitsu et al.
5,114,144 A 5/1992 Baum
5,131,651 A 7/1992 You
5,165,686 A 11/1992 Morgan
5,180,163 A 1/1993 Lanctot et al.
5,217,221 A 6/1993 Baum
5,217,223 A 6/1993 Feeney
5,219,163 A 6/1993 Watson
5,301,940 A 4/1994 Seki et al.
5,364,095 A 11/1994 Easton et al.
5,380,003 A 1/1995 Lanctot
5,395,108 A 3/1995 Souders et al.
5,409,214 A 4/1995 Cook
5,458,330 A 10/1995 Baum
5,460,369 A 10/1995 Baum
5,511,777 A 4/1996 McNeely
5,533,723 A 7/1996 Baum
5,593,158 A 1/1997 Filice et al.
5,620,179 A 4/1997 MacKay, Jr.
5,624,114 A 4/1997 Kelsey
5,624,115 A * 4/1997 Baum ..... 473/567
5,676,609 A 10/1997 Mollebaek
5,676,610 A 10/1997 Bhatt et al.
5,722,908 A 3/1998 Feeney et al.
5,759,113 A 6/1998 Lai et al.
D398,680 S 9/1998 Kennedy et al.
5,800,293 A 9/1998 MacKay, Jr.
5,820,438 A 10/1998 Horton, III
5,833,561 A 11/1998 Kennedy et al.
6,022,282 A 2/2000 Kennedy et al.
6,036,610 A * 3/2000 Lewark ..... 473/564
6,042,493 A * 3/2000 Chauvin et al. ..... 473/566
6,053,828 A 4/2000 Pitsenberger
6,139,451 A * 10/2000 Hillerich et al. ..... 473/564
6,159,116 A * 12/2000 Pitsenberger ..... 473/566
6,344,007 B1 * 2/2002 Feeney et al. ..... 473/567
6,440,017 B1 * 8/2002 Anderson ..... 473/566
6,461,260 B1 * 10/2002 Higginbotham ..... 473/566
2001/0046910 A1 11/2001 Sutherland ..... 473/564

* cited by examiner

COMPOSITE WRAP BAT

APPLICATION FOR UNITED STATES LETTERS PATENT

This application is a continuation of U.S. patent application Ser. No. 09/571,018 filed May 15, 2000, now U.S. Pat. No. 6,461,260 entitled "Composite Wrap Bat" which is hereby incorporated by reference.

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

Be it known that we, Brian E. Higginbotham, a citzen of the United States, residing at 406 Westside Heights Dr., Tullahoma, Tenn.; and Terry Sutherland, a citizen of Canada residing in Ottawa, Canada, have invented a new and useful "Composite Wrap Bat."

BACKGROUND OF THE INVENTION

1. Field of the Invention

The present invention relates generally to the construction of baseball and softball bats, and more particularly, but not by way of limitation, to lighter and stronger bat constructions provided by the use of an external composite wrap on a portion of a metal bat frame.

2. Description of the Prior Art

One recent advancement in the design of high performance baseball and softball bats includes the use of an external metal shell formed about, an internal tubular bat frame as disclosed in U.S. Pat. No. 6,053,828, by Pitsenberger for "Softball Bat With Exterior Shell", assigned to the assignee of the present invention, the details of which are incorporated herein by reference.

The prior art has also included a number of other proposals for bat designs including internal and external sleeves, some of which have been constructed from composite materials.

For example, U.S. Pat. No. 5,364,095 assigned to Easton, Inc., discloses a tubular metal bat having an internal fiber composite sleeve.

U.S. Pat. No. 6,022,282 issued to Kennedy et al., discloses a ball bat having an internal metal tube surrounded by an external composite tube along its entire length (see FIG. 3).

U.S. Pat. No. 5,722,908 discloses a composite bat with a metal barrel area.

Upon review of these prior art designs, it will be seen that none of them show or suggest the use of a composite external layer along only a portion of the bat for either the strengthening of the bat at a point of maximum bending moment, or for increasing the external durability of the bat to reduce denting and the like upon impact with a ball.

SUMMARY OF THE INVENTION

The present invention provides several alternative designs for a bat including a metal frame with an exterior fiber reinforced composite shell.

In one embodiment, the bat includes a metal frame having a fiber reinforced composite outer shell formed directly about the barrel portion of the bat. Preferably, the metal frame includes a handle portion, a transition portion and a barrel portion, with the metal frame having an annular step defined therein distally of the handle portion. The fiber reinforced composite outer shell is formed about the metal frame and has a proximal end located adjacent the annular step of the metal frame.

In a second embodiment of the invention, the barrel portion of the bat includes an outer metal shell formed about the barrel portion of the frame, with a fiber reinforced composite outer shell formed about the outer metal shell.

In still a third embodiment of the invention, a fiber reinforced composite outer shell is formed around only an intermediate portion of the metal frame spanning a point of maximum bending stress, so as to provide increased stiffness of the bat at the area of the point of maximum bending stress. The metal frame of the bat extends both proximally and distally from the intermediately located fiber reinforced composite outer shell.

Methods of manufacturing bats utilizing a composite wrapped exterior shell are also disclosed.

Accordingly, it is an object of the present invention to provide improved baseball and softball bats having selected portions of a metal bat frame reinforced by an exterior fiber reinforced composite shell.

Another object of the present invention is the provision of bats having a lighter, yet stronger, construction than conventional bat designs.

Still another object of the present invention is the provision of a bat having a metal bat frame which is selectively reinforced at selected portions thereof by a fiber reinforced composite outer shell.

Still another object of the present invention is the provision of bats having improved durability and resistance to denting.

And another object of the present invention is the provision of bats having improved performance characteristics so that they will hit a ball further.

And another object of the present invention is the provision of improved methods for construction of bats having a metal frame with an exterior composite layer.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Figure 1:
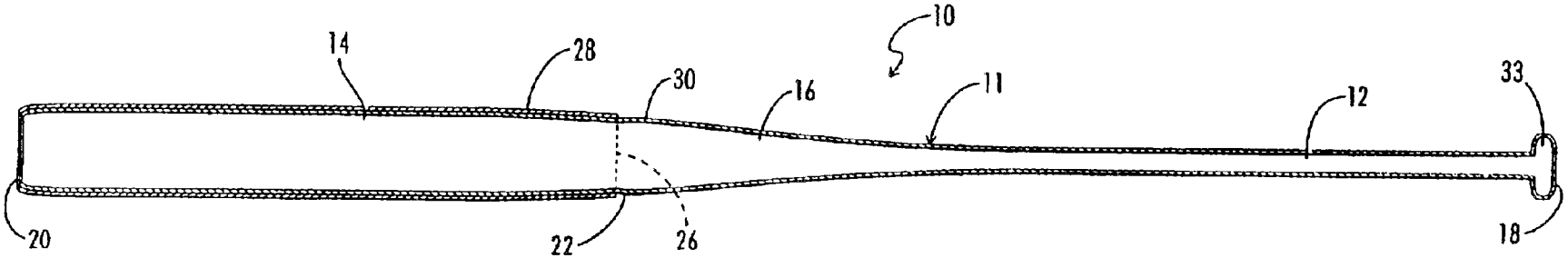
FIG. 1 is a lengthwise sectioned view of a first embodiment of a bat with a metal frame and an exterior composite shell around the barrel area.

Referring now the drawings, and particularly to FIG. 1, a bat is shown and generally designated by the numeral 10. The bat 10 includes a metal frame 11 including a handle portion 12, a barrel portion 14, and a transition portion 16 joining the handle portion 12 and barrel portion 14.

The bat frame 11 can be generally described as having a proximal end 18 and a distal end 20.

As seen in FIG. 1, at about the location of the junction between the transition portion 16 and the barrel portion 14, there is an annular step 22 formed in the bat frame 11. The annular step 22 can be described as being located distally of the handle portion 12.

A fiber reinforced composite outer shell 24 is formed about the metal frame 11. The outer shell 24 has a proximal end 26 located adjacent the annular step 22 of the metal frame 11.

The fiber reinforced composite outer shell 24 terminates distally of the handle portion 12 so that the handle portion 12 is not covered by the outer shell 24.

As seen in FIG. 1, an exterior surface 28 of the composite outer shell 24 and an exterior surface 30 of the metal frame just proximal of the annular step 22 substantially align to define a smooth outer profile of the bat 10 in the area of the annular step 22.

The distal end 20 of the bat 10 is preferably closed by a conventional end plug (not shown).

A knob 33 is attached, typically by welding, to the proximal end 18 of the bat frame 11.

Figure 2:
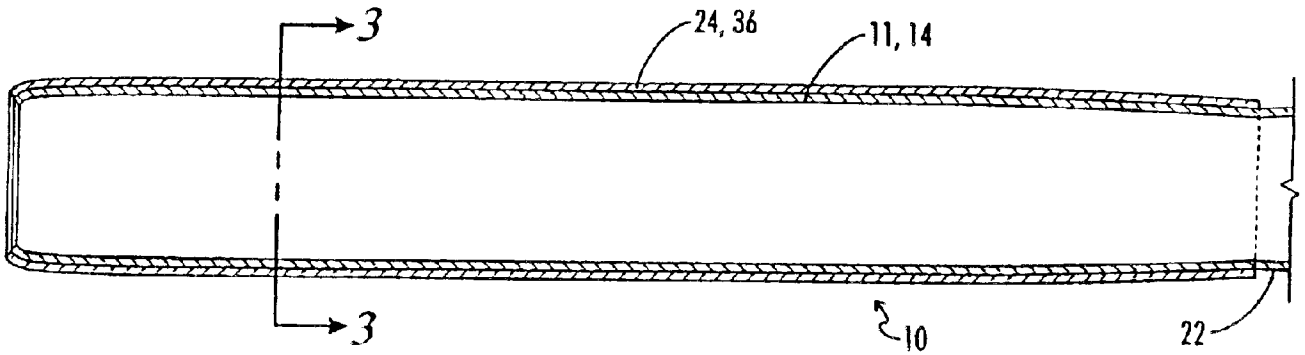
FIG. 2 is an enlarged view of a portion of the barrel of the bat of FIG. 1.

FIG. 2 is an enlarged cross-sectional view of a segment of the barrel portion 14 of the bat 10, and shows the manner of construction of the fiber reinforced composite outer shell 24.

In the embodiments of FIGS. 1 and 2, the fiber reinforced composite outer shell 24 is formed directly on and bonded to the barrel portion 14 of the bat frame 11.

The outer shell 24 is preferably formed of a bidirectional fiber reinforced sock placed about barrel portion 14. The details of construction of the sock 36 are further illustrated and described with reference to FIGS. 8 and 9. After placing the sock 36 around the barrel portion 14, the sock 36 is impregnated with a resin matrix which is then allowed to harden to form a hardened outer shell or outer layer 24 about the metal bat frame 11.

Suitable material for the bidirectional fiber reinforced sock exterior layer 36 includes woven fiberglass or carbon fiber or like materials.

Suitable resin matrix material for impregnating the fiber layers includes two-part epoxy resin with various rubber materials added for greater impact resistance.

In this manner, a bat is provided which can have a much thinner metal barrel portion 14 than would a traditional bat, thus providing a lighter bat, which provides the necessary additional strength via the fiber reinforced composite exterior shell 24.

For example, a satisfactory bat like that illustrated in FIGS. 1 and 2 having the fiber reinforced composite outer layer placed directly upon the barrel portion 14 of the bat frame 11, and wherein the bat frame 11 is constructed of a conventional aluminum material such as 7055 aluminum alloy, the metal barrel portion would have a wall thickness in the range of 0.040 to 0.125 inches, in the fiber reinforced composite outer shell 24 will have a wall thickness in the range of 0.020 to 0.100 inches.

With this construction wherein the barrel portion of the bat is surrounded by a fiber reinforced composite outer shell, the outer shell reduces denting of the barrel portion of the bat when used to strike a ball.

As seen in FIG. 1, the sock 36 of the outer shell 24 is a tubular sock which is open at both its proximal and distal ends.

Figure 9:
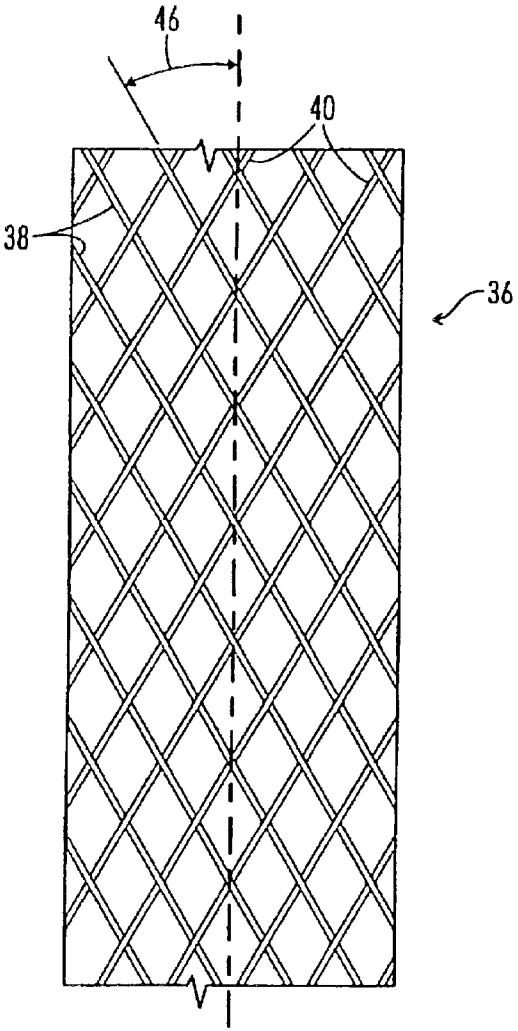
FIG. 9 is a view similar to FIG. 8, showing the sock of FIG. 8 having been stretched in a longitudinal direction so that its fibers now are oriented at an angle of approximately 30° to the longitudinal axis of the sock.
Figure 8:
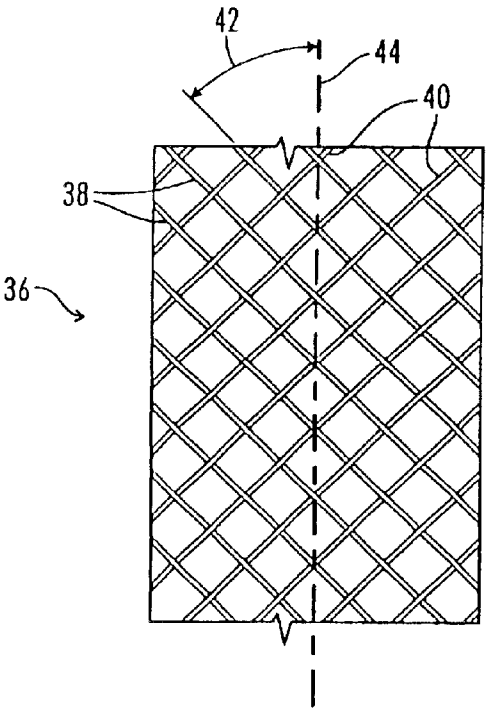
FIG. 8 is a schematic lengthwise illustration of a bidirectional fiber reinforced sock having the fibers laying at an angle of approximately 45° to a longitudinal axis of the sock.

As shown in FIG. 8, the sock 36 is a woven sock which in a relaxed condition has bidirectional fiber orientations running crosswise to each other. As schematically illustrated in FIG. 8, the group of fibers 38 is oriented substantially perpendicular to a second group of fibers 40, each of which is oriented at an angle 42 of approximately 45° to a longitudinal axis 44 of the sock 36. FIG. 8 illustrates the condition of the sock 36 prior to being placed upon the bat 10. As the sock 36 is pulled into place about the bat 10, it stretches parallel to its longitudinal axis 44, so that the stretched sock has a stretched bidirectional fiber orientation at an angle 46 which in the illustrated embodiment is approximately 30°, as shown in FIG. 9.

An alternative version of the fiber reinforced composite outer shell may also include an inner layer (not shown) of unidirectional fiber reinforced tape, such as a carbon fiber tape, which is wrapped around the barrel portion 14 of bat frame 11 prior to placement of the sock 36 about the layer of unidirectional wrapped tape. Any other conventional constructions of fiber reinforced composite materials may be utilized.

Figure 4:
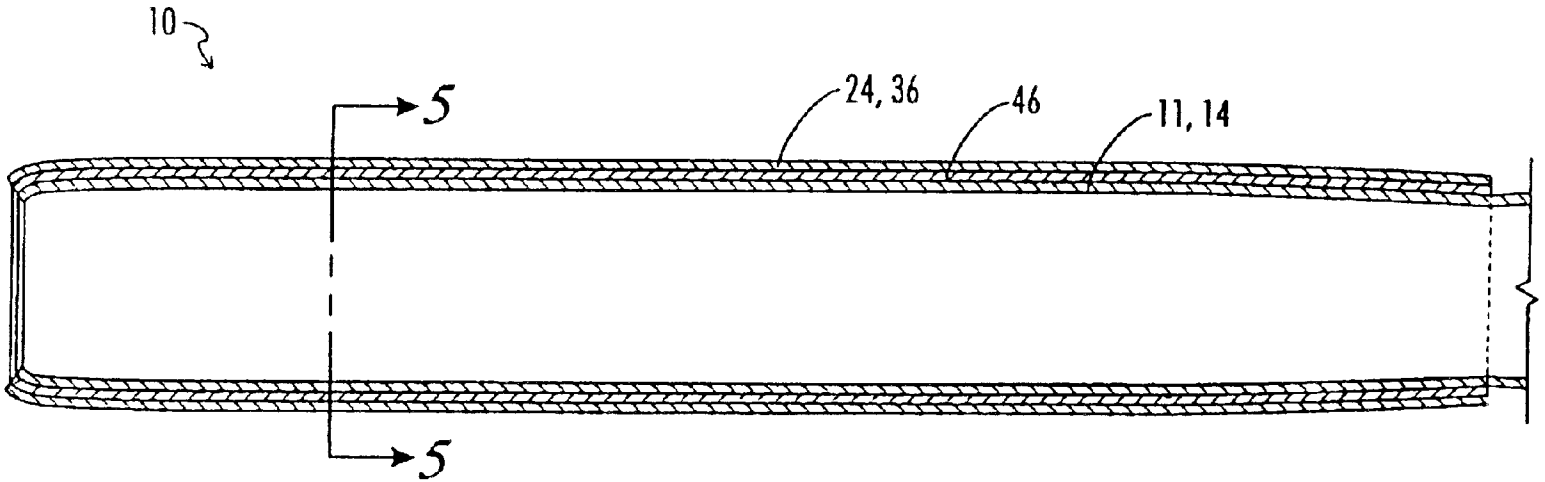
FIG. 4 is a cross-sectional view similar to FIG. 2 of a second embodiment of the invention wherein the metal frame of the bat is surrounded by an outer metal sleeve which is in turn surrounded by a composite shell.
Figure 5:
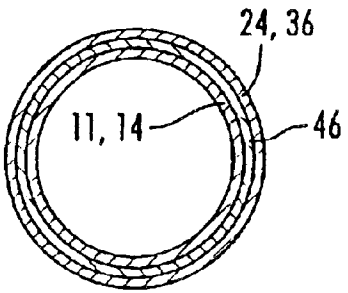
FIG. 5 is a cross-sectional view taken along line 5—5 of FIG. 4.

Turning now to FIGS. 4 and 5, a second embodiment of the invention is illustrated. In this embodiment, the barrel portion 14 of the metal bat frame 11 has received thereabout an outer metal sleeve 46 which is constructed in a manner substantially like that of Pitsenberger U.S. Pat. No. 6,053,828, the details of which are incorporated herein by reference. This external metal sleeve 46 covers the barrel portion 14 of the bat and terminates adjacent the annular step 22 so that it is substantially co-extensive with the outer composite shell 24 seen in FIG. 1. In the embodiment of FIGS. 4 and 5, the outer composite shell 24 is in fact formed on the outer metal shell 46.

Figure 3:
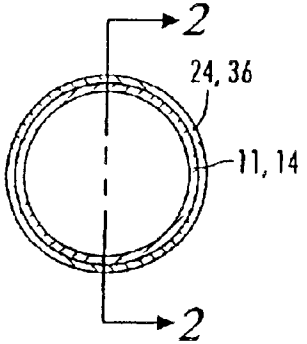
FIG. 3 is a cross-sectional view taken along lines 3—3 of FIG. 2.

Thus, after formation of the outer metal shell 46 about the metal bat frame 11 in a manner like that described in U.S. Pat. No. 6,053,828, the fiber reinforced composite outer shell 24 is formed upon the outer metal shell 46 in a manner like that just described with regard to the embodiment of FIGS. 1–3.

With the embodiment of FIGS. 4 and 5, the outer metal shell 46 may be thinner than the outer shell of the Pitsenberger application, and additional reinforcement is provided by the exterior fiber reinforced composite layer 24.

With the embodiment of FIGS. 4 and 5, the dimensions of the metal bat frame 11, the outer metal shell 46 and fiber reinforced composite outer shell 24, and the dimensions of the annular step 22, are preferably chosen so that the exterior surface of the fiber reinforced composite outer shell 24 aligns with the exterior surface of the transition portion 16 of the bat to form a substantially smooth and continuous exterior bat surface across the annular step 22.

In one preferred example of a bat constructed as shown in FIGS. 4 and 5, the metal barrel portion 14 of bat frame 11 has a wall thickness of approximately 0.047 inches and has an outside diameter of 2.060 inches. The exterior metal shell 46 has a wall thickness of 0.055 inches and has an outside diameter of 2.170 inches. Both the bat frame 11 and the outer metal shell 46 are constructed of 7055 aluminum alloy. This example has a composite outer shell 24 constructed from the woven fiber sock 30 having a wall thickness of 0.030 inches and having an outside diameter of 2.230 inches.

More generally, a bat constructed as shown in FIGS. 4 and 5 can be described as having an aluminum bat frame 11 and an aluminum metal outer shell 46, each of which has a wall thickness in the range of 0.030 to 0.060 inches. The bat has a fiber reinforced composite outer shell 24 having a wall thickness in the range of 0.020 to 0.0100 inches.

Figure 10:
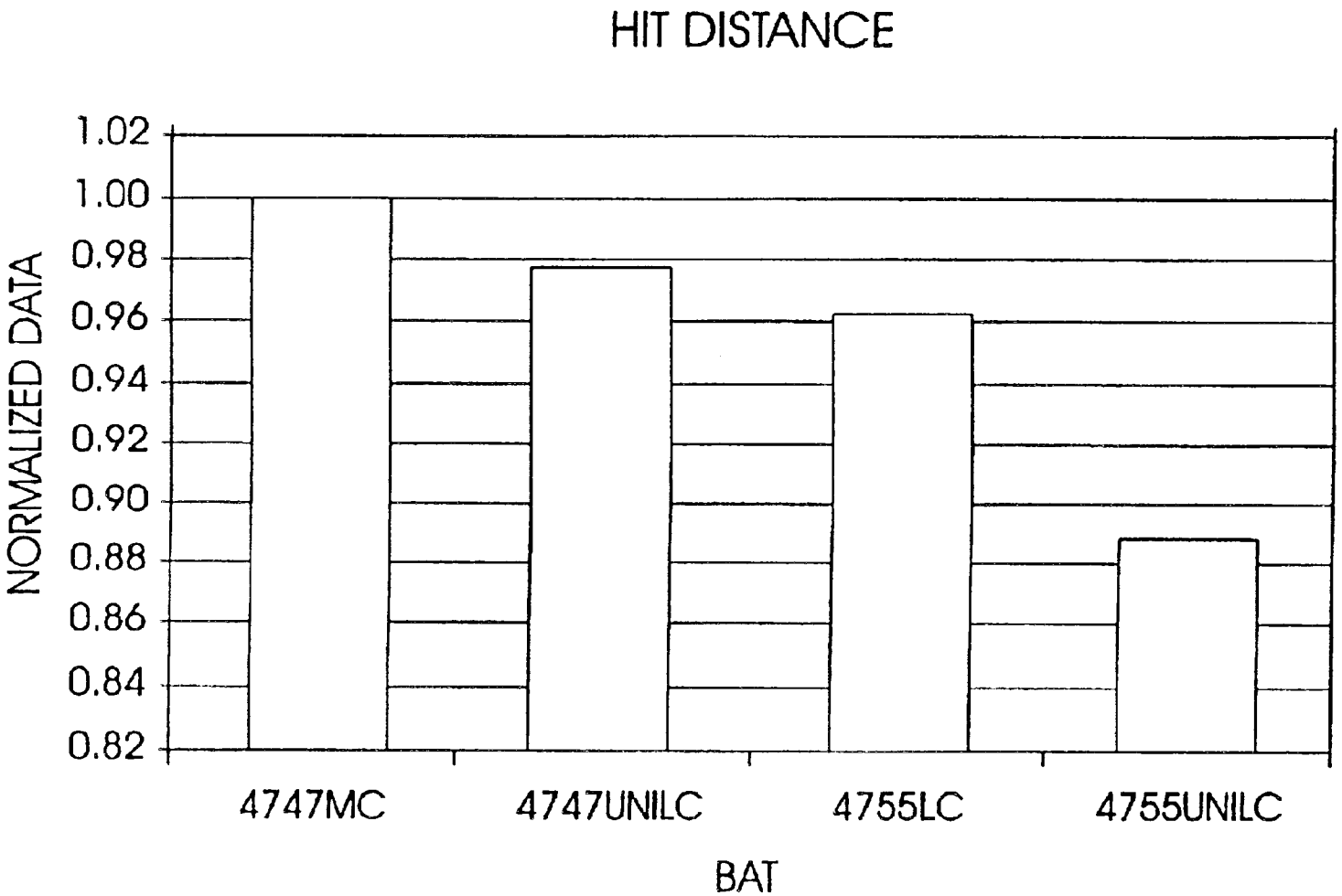
FIG. 10 is a chart showing hit distance versus bat construction for several example bats.

FIG. 10 graphically illustrates the performance of several examples of is bats constructed in accordance with FIGS. 4 and 5. The vertical axis represents normalized distance the bat will hit a ball, with the longest distance represented as 1.0. The four examples are labeled to identify the wall thicknesses of the bat frame 14, and metal shell 46, and the type and thickness of composite construction. Example 4747MC had a barrel wall thickness 14 of 0.047 inches, a metal shell 46 wall thickness of 0.047 inches, and a composite layer 24 made up of a medium weight carbon fiber sock 36 resulting in a composite shell 24 having a wall thickness of 0.030 inches. Example 4747UNILC differed in that its composite layer 24 was made up of a first layer of unidirectional carbon fiber tape covered by a light weight carbon fiber sock. Example 4755LC had a barrel wall thickness of 0.047 inches, a metal shell wall thickness of 0.055 inches, and a composite layer made up of a light weight carbon fiber sock. The final example 4755UNIIC added a layer of unidirectional tape to the third example. Thus, the optimum example of the four tested was 4747MC.

Figure 6:
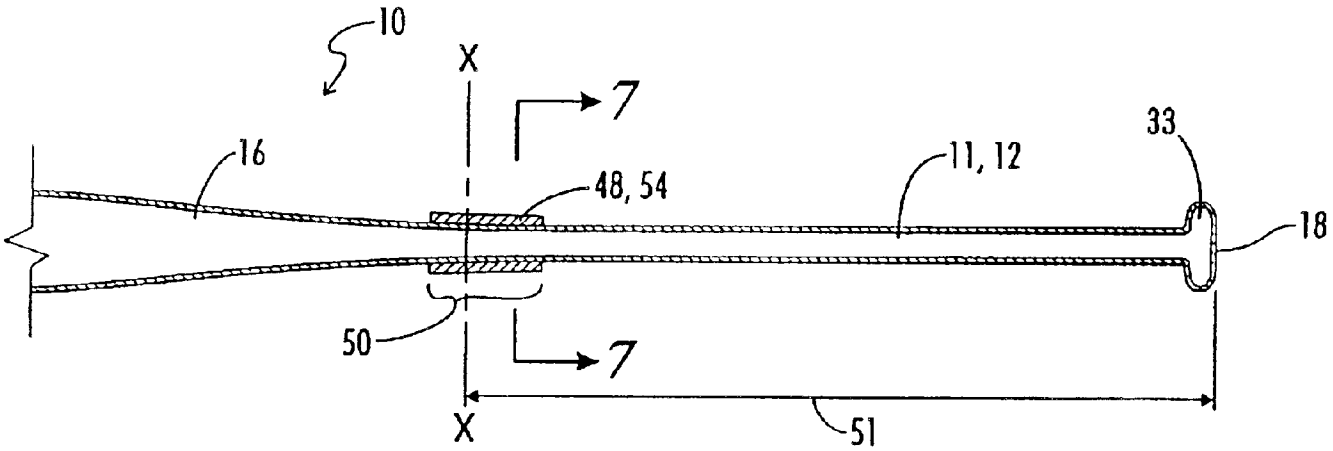
FIG. 6 is a longitudinal section view of yet another embodiment of the invention having an exterior fiber reinforced composite layer formed around an intermediate portion of the bat subjected to a maximum bending stress.
Figure 7:
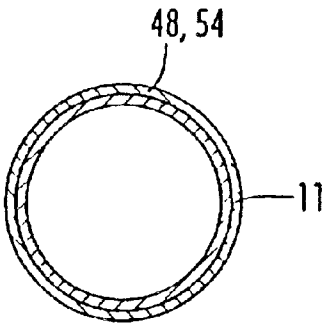
FIG. 7 is a cross-section of the bat of FIG. 6 taken along lines 7—7 of FIG. 6.

FIGS. 6 and 7 illustrate a third embodiment of the invention wherein a fiber reinforced composite outer shell 48 is formed only about an intermediate portion 50 of the metal frame 11.

It will be understood that for any given design of a bat, the bat frame will have a point along its length which is subjected to a maximum bending stress when the bat is used to strike a ball. For example, the bat shown in FIG. 6 may have a point of maximum bending stress along the line x—x. For example, for a typical aluminum bat construction, the point of maximum bending stress x—x would be located a distance 51 from the proximal end 18 of the bat, which distance would typically be approximately 11 inches and would place the point of maximum bending stress x—x in the distal part of the handle portion 12 of the bat frame 11.

The present invention also envisions the selective strengthening of a metal bat by the placement of a fiber reinforced composite outer shell 48 only around an intermediate portion 50 of the bat frame which spans the point x—x of maximum bending stress, so as to provide increased stiffness of the bat in the area of maximum bending stress.

With reference to FIG. 7, the outer shell 48 will preferably be formed of a layer 54 formed of a bidirectional fiber reinforced sock, with a matrix of resin material impregnating the sock 54 to form a hardened outer layer or shell 48.

Again, such a construction can allow a given bat to be made of a thinner wall thickness metal material than would a traditional metal bat. One specific example of such a bat would have an aluminum bat frame 11 having a wall thickness in the area x—x of approximately 0.085 inches, reinforced by a fiber reinforced composite outer layer shell 48 having a wall thickness of 0.030 inches. More generally, such a bat can be described as an aluminum metal bat having a wall thickness at point x—x or in the intermediate portion 50 in the range of 0.050 to 0.100 inches, and having a composite outer shell 48 with a wall thickness in the range of 0.020 to 0.100 inches.

With this construction, the outer shell 48 is formed only about the intermediate portion 50 of the bat frame 11 so that the bat frame 11 extends both distally and proximally out of the outer shell 48. In this construction, the primary purpose of the fiber reinforced composite outer layer 48 is to strengthen the bat in its zone of maximum bending stress.

The selective use of strategically positioned fiber reinforced composite outer layers on a metal bat provide a number of advantages over bats constructed solely of metal. Using composite materials allows the designer more flexibility in the design of the bat. This design flexibility covers virtually all parameters that add value to a bat, including performance, durability and weight. More specifically, composite materials allow the bat to be designed for varying stiffness at desired locations, weight savings for either lighter weight or a variety of weight distributions, and strength increases for durability gains.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A bat, comprising:

a metal frame having a handle portion, a transition portion and a barrel portion, the frame having a point of maximum bending stress when the bat is used to strike a ball; and a fiber reinforced composite outer shell formed around only an intermediate portion of the metal frame and spanning the point of maximum bending stress, so as to provide increased stiffness of the bat in the area of the point of maximum bending stress.

2. The bat of claim 1, wherein the metal frame has a wall thickness in the range of 0.050 to 0.100 inches at the point of maximum bending stress.

3. The bat of claim 2, wherein the composite outer shell has a thickness in the range of 0.020 to 0.100 inches.

* * * * *